US006666725B2

(12) United States Patent
Botka et al.

(10) Patent No.: US 6,666,725 B2
(45) Date of Patent: Dec. 23, 2003

(54) BROADBAND COAXIAL MICROWAVE CONNECTOR

(75) Inventors: Julius K. Botka, Santa Rosa, CA (US); Michael T. Powers, Santa Rosa, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 276 days.

(21) Appl. No.: 09/883,694

(22) Filed: Jun. 18, 2001

(65) Prior Publication Data

US 2002/0193007 A1 Dec. 19, 2002

(51) Int. Cl.[7] ..... H01R 24/00
(52) U.S. Cl. ..... 439/675
(58) Field of Search ..... 439/289, 675, 439/575, 668, 669, 578, 580

(56) References Cited

U.S. PATENT DOCUMENTS 3,441,898 A * 4/1969 Nodfelt ..... 439/289
4,431,242 A * 2/1984 Gisewsky ..... 439/289
4,801,274 A 1/1989 Royce
5,865,654 A 2/1999 Shimirak et al. ..... 439/852

* cited by examiner

*Primary Examiner*—Son V. Nguyen

(57) ABSTRACT

A connector assembly includes a first connector half, and a second. The first connector half includes a first transmission line, having a first outer conductor and a first center conductor. The first center conductor has a first end that has an angled flat region. The second connector half, includes a second transmission line. The second transmission line includes a second outer conductor and a second center conductor. The second center conductor has a first end that has an angled flat region. When the first connector half and the second connector half are connected together, the first outer conductor is electrically connected to the second outer conductor. Additionally, a wiping contact is established between the angled flat region of the first end of the first center conductor and the angled flat region of the first end of the second center conductor.

14 Claims, 5 Drawing Sheets

BROADBAND COAXIAL MICROWAVE CONNECTOR

BACKGROUND

The present invention concerns microcircuit housing and cable connectors and pertains particularly to a broadband coaxial microwave connector.

For telecommunications applications with signal frequencies below 2 gigahertz, a variety of connectors for coaxial cable systems are used. For example, the most common type of connector is an F-connector that includes a male F-connector part and a female F-connector part. A male F-connector is typically used to terminate a coaxial cable. A female F-connector may be used to join two cables together or to connect a cable to a device.

Other coaxial cable connectors include use of an electrical socket that include cantilever spring tines which terminate in a convex cross section at their free ends. The spring tines expand as they guide an inserted pin during engagement. Another coaxial cable connector uses a circular sleeve having a plurality of spaced-apart, axially oriented tines. Another coaxial cable connector uses spring tabs. For a general discussion on low cost coaxial cable connectors, see for example, U.S. Pat. No. 5,865,654.

For microwave applications, conventional coaxial connectors can include an inner conductor, an outer conductor and an inwardly threaded nut. The inwardly threaded nut is designed to engage an outwardly threaded mating connector. Front faces of respective inner conductors and outer conductors contact each other at a reference plane once the nut is threaded onto the receiving outer conductor. To permit machining of the conductors, a moderately soft conductor material, such as beryllium-copper alloy, is used. To maximize performance, the inner and outer conductors can be gold plated. The gold provides optimal conductivity and resistance to oxidation and other forms of corrosion.

In one microwave coaxial connector, an outer conductor and a coupling nut are configured to incorporate ball bearings therebetween to minimize frictional engagement as the nut is tightened down on a receiving connector. The ball bearings are placed between an outer surface of the outer conductor and an inner surface of the nut. The ball bearings minimize friction between the nut and the outer conductor to which it is coupled. As a result, relative rotation of mating faces is minimized as the nut is tightened. Thus, damage to mating faces is minimized. As an additional advantage, torque-induced stress on cables and devices mechanically coupled to the connectors is minimized. See, for example U.S. Pat. No. 4,801,274.

To achieve a wiping contact on the center conductors, previous connector designs use a pin and slotted socket design. Alternatively, in sexless connectors, compressible collets are imbedded in the ends of the butting center conductors. While this works acceptably for coaxial connectors having a center conductor diameter of about 0.43 millimeter (mm), such connection of center conductors is not practical for a DC to 200 gigahertz (GHz) connector where the center conductor of a transmission line portion has a diameter of about 0.254 mm.

There are connection techniques that can be used for implementing connection of transmission lines where the center conductor of a transmission line has a diameter of about 0.254 mm. These include ribbon bonding or overlapping transmission line connections. However this style of connection is impractical for applications where there are repeated connects and disconnects. Nevertheless, it is desirable to have such a broadband coaxial connector for DC to 200 GHz that can be installed on a test instrument or a microcircuit to be used inside an instrument or a product.

SUMMARY OF THE INVENTION

In accordance with the preferred embodiment of the present invention, a connector assembly includes a first connector half and a second. The first connector half includes a first transmission line that has a first outer conductor and a first center conductor. The first center conductor has a first end that has an angled flat region. The second connector half includes a second transmission line. The second transmission line includes a second outer conductor and a second center conductor. The second center conductor has a first end that has an angled flat region. When the first connector half and the second connector half are connected together, the first outer conductor is electrically connected to the second outer conductor. A wiping contact is established between the angled flat region of the first end of the first center conductor and the angled flat region of the first end of the second center conductor.

DESCRIPTION OF THE PREFERRED EMBODIMENT

Figure 1:
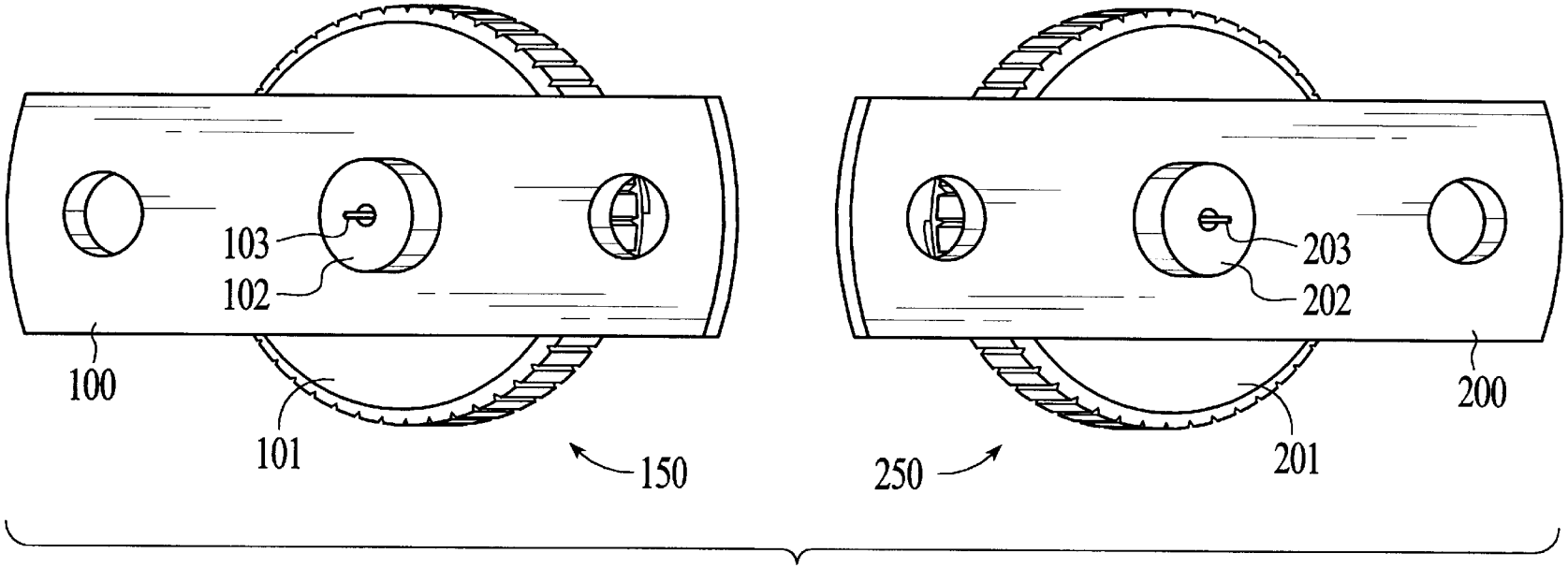
FIG. 1 shows a back view of a keyed coupled mating system in accordance with a preferred embodiment of the present invention.

FIG. 1 shows a back view of two identical connector halves that form a keyed coupled mating system. A first connector half 150 is shown in FIG. 1 to include a flange 100 and a coupling nut 101. A transmission line connected to the first connector half 150 includes an outer conductor 102 and a center conductor 103. For example, outer conductor 102 has a 0.60 mm (0.0236 inch) interior diameter to enable it to work mode free to 200 GHz. Center conductor 103 has a 0.254 mm (0.010 inch) outer diameter. This results in a 50 ohm transmission line.

A second connector half 250 is shown in FIG. 1 to include a flange 200 and a coupling nut 201. A transmission line connected to the second connector half 250 includes an outer conductor 202 and a center conductor 203. For example, outer conductor 202 has a 0.60 mm (0.0236 inch) interior diameter to enable it to work mode free to 200 GHz. Center conductor 203 has a 0.254 mm (0.010 Inch) outer diameter. This results in a 50 ohm transmission line.

Figure 2:
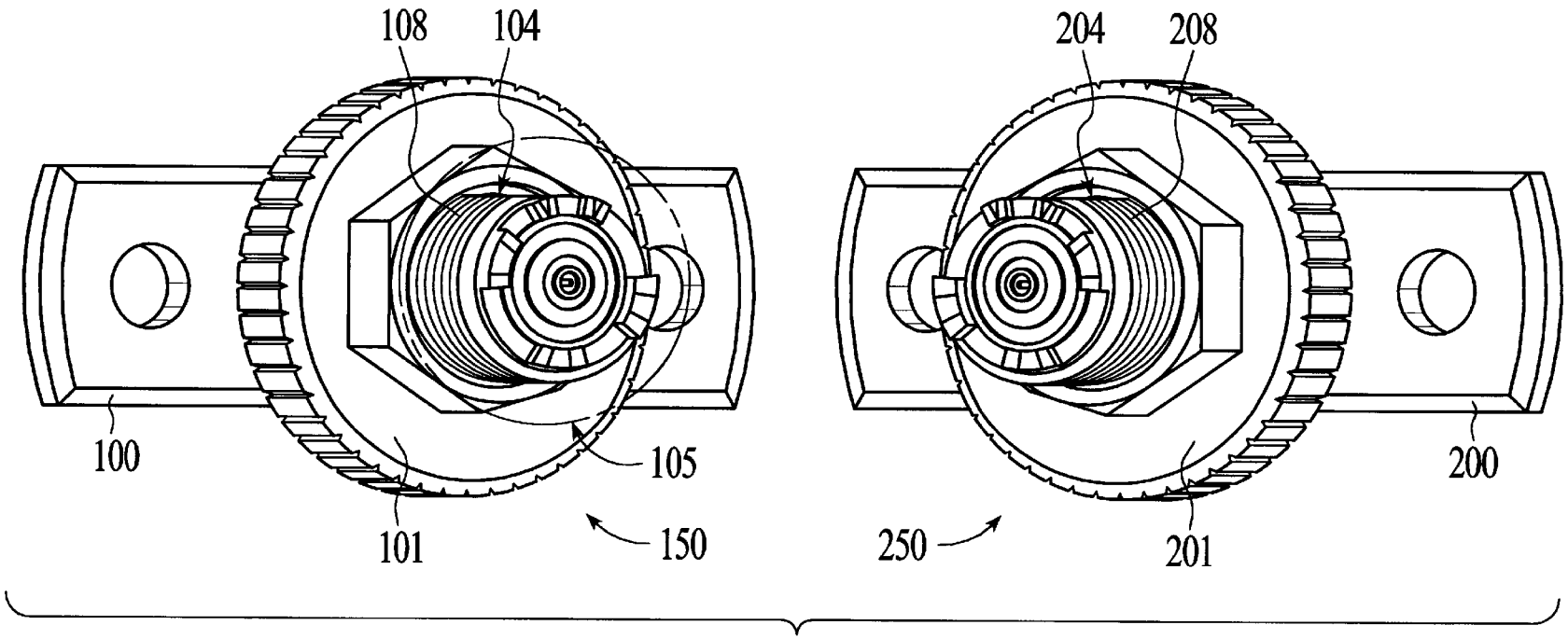
FIG. 2 shows a front view of a keyed coupled mating system in accordance with a preferred embodiment of the present invention.

FIG. 2 shows a front view of the two connector halves forming the keyed coupled mating system. When an outer threaded body 108 with a flat 104 of first connector half 150 and an outer threaded body 208 with a flat 204 of second connector half 250 are oriented the same, they can be mated.

In the preferred embodiment, first connector half 150 and second connector half 250 can only be mated in this one orientation. A close up of an area 104 of FIG. 2 is shown in FIG. 3.

Figure 3:
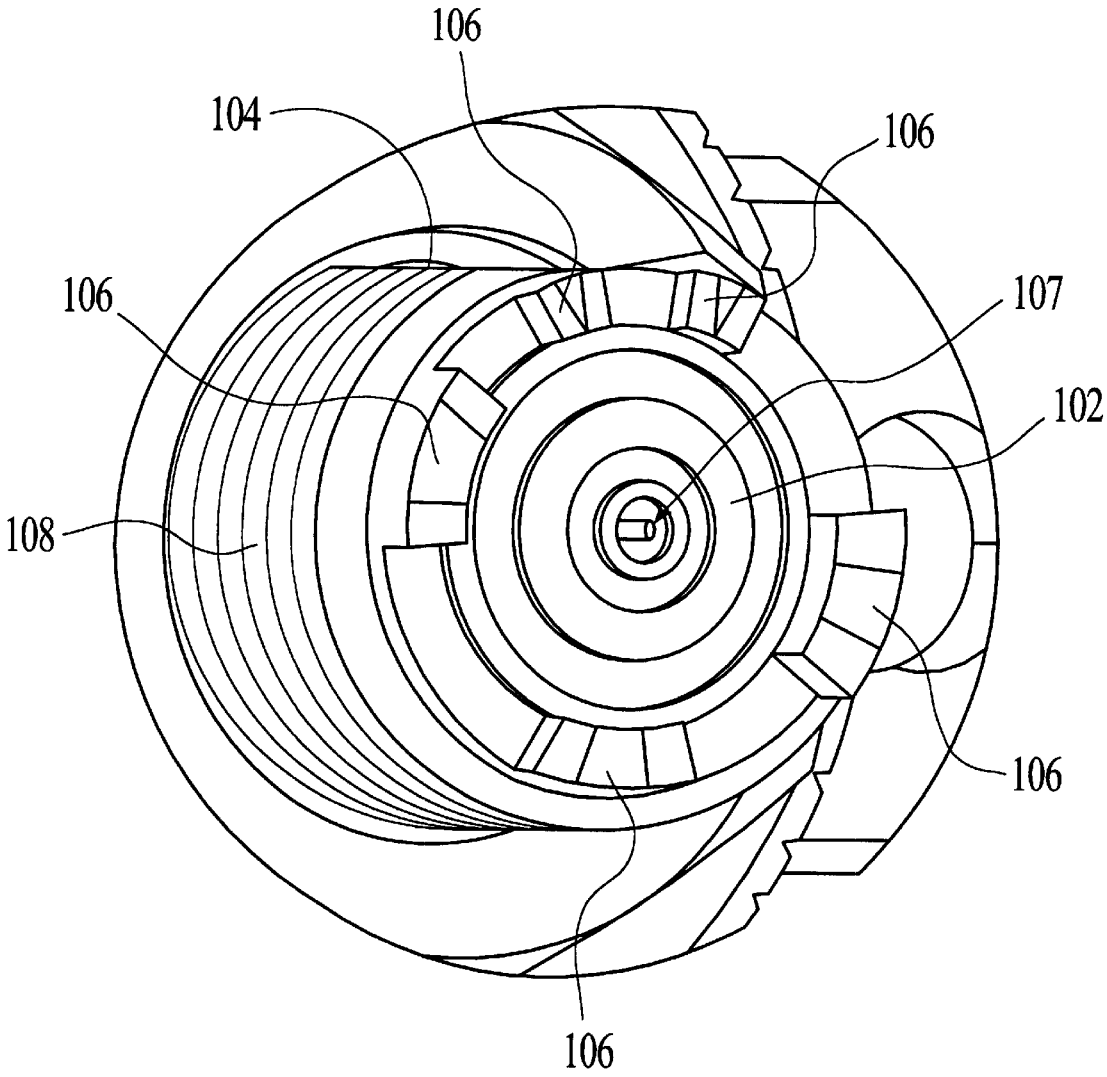
FIG. 3 shows additional detail of one connector half in accordance with a preferred embodiment of the present invention.

FIG. 3 shows an example arrangement of cogs 106 on threaded body 108. When the connector is fully mated, an angled flat region 107 of center conductor 103 forms a wiping contact with a corresponding angled flat region of center conductor 203. Thus, threaded body 108 and threaded body 208 act as keyed coupling bodies.

Figure 4:
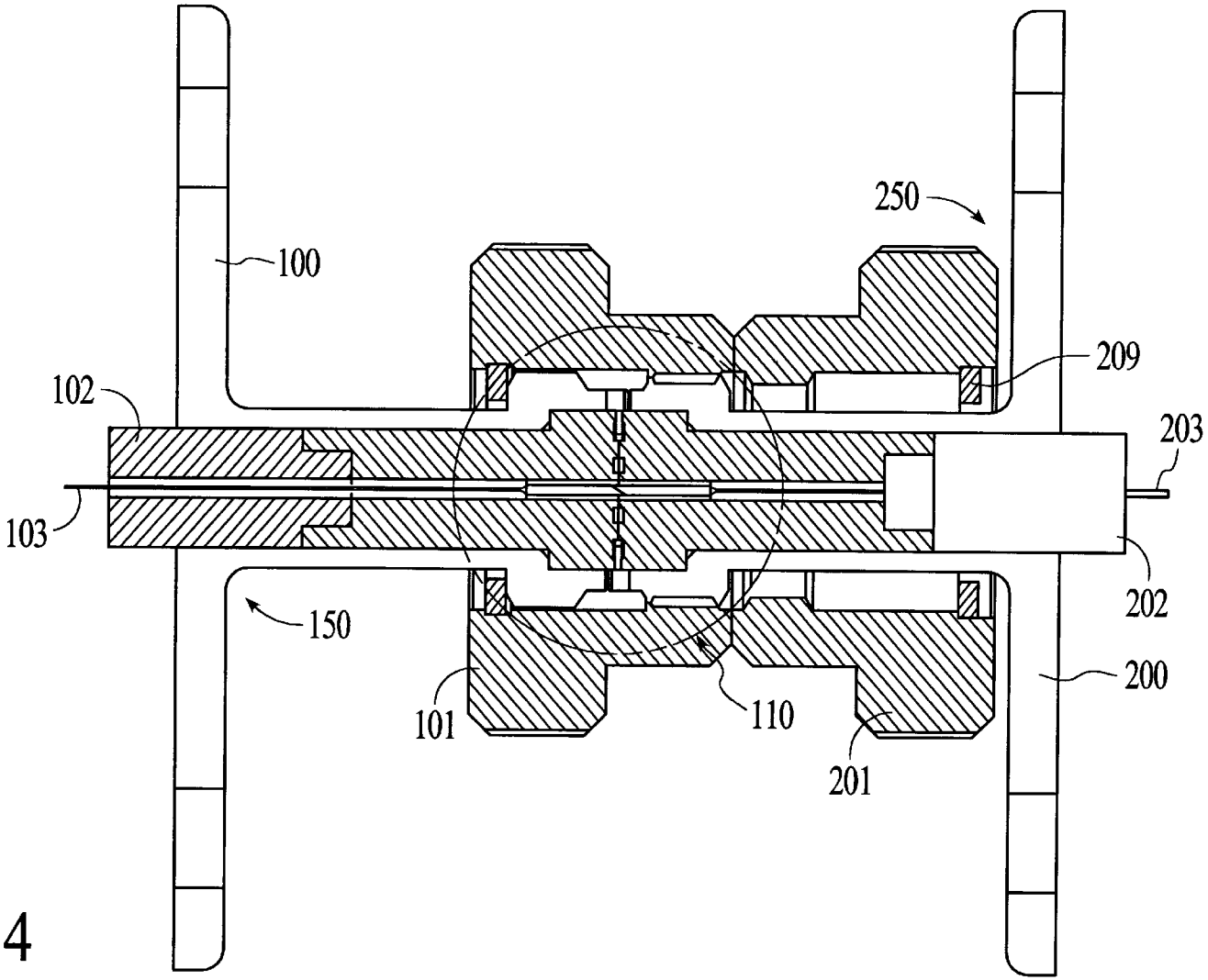
FIG. 4 is a cross-sectional view of connection of connector halves in accordance with a preferred embodiment of the present invention.

FIG. 4 is a cross-sectional view of connector halves 150 and 250 coupled together. The procedure to perform the mating is performed as described immediately below.

Coupling nuts 101 and 201 are spun completely back to connector flanges 100 and 200, respectively. This exposes the threads on outer threaded bodies 108 and 208. Connector halves 150 and 250 to be mated should be in the same orientation. This can be verified by orienting flat 104 and flat 204 either both up or down. Connector halves 150 and 250 are then swiveled 90 degrees toward each other and brought together so that they are axially in line. When they are in the right orientation, the cogs on outer threaded bodies 108 and 208 fit together (only one way). Connector halves 150 and 250 are brought together so that outer conductors 102 and 202 touch. The angled flat regions 107 and 207 (shown in FIG. 5) on center conductors 103 and 203, respectively, are thus in the right orientation and since they are slightly longer then the outer conductors 102 and 202, respectively, angled flat regions 107 and 207 will slide on each other and make a wiping contact as the connection of connector halves 150 and 250 is tightened.

One of the two coupling nuts is spun toward the interface of connector halves 150 and 250, first over the threads of its' own outer threaded body, then threaded on to the outer threaded body on the opposing side. For example, in FIG. 4, coupling nut 101 is spun toward the interface of connector halves 150 and 250, first over the threads of outer threaded body 108, then threaded on to outer threaded body 208 while disengaging thread on outer threaded body 108. By this action outer threaded body 208 is pulled toward outer threaded body 108. A 5 Inch-Pound torque wrench is used to tighten the connection. The torque wrench for subminiature type A (SMA) connectors is recommended.

A coupling nut snap ring 209 is also shown in FIG. 4. A close up of an area 110 of FIG. 4 is shown in FIG. 5.

Figure 5:
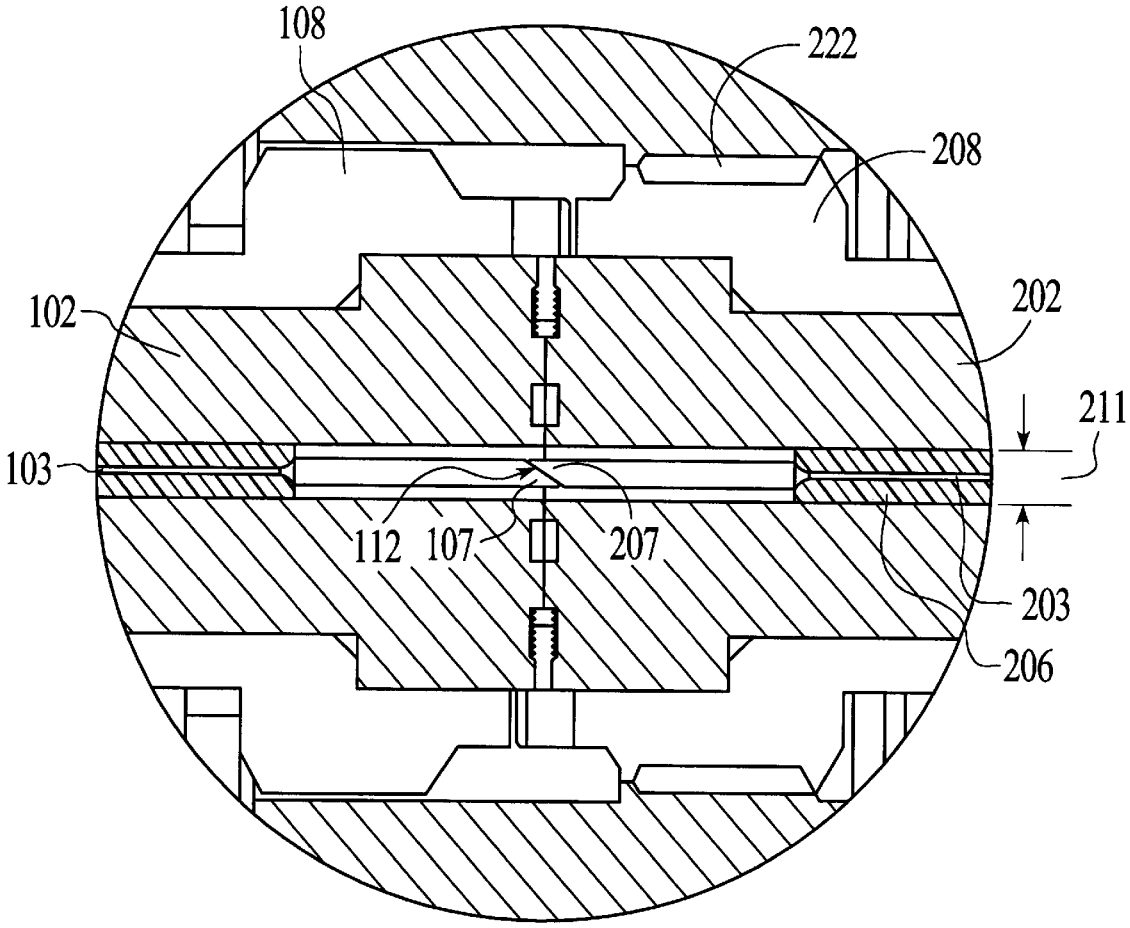
FIG. 5 shows additional detail of the connection of the connector halves shown in FIG. 4 in accordance with a preferred embodiment of the present invention.

FIG. 5 shows additional detail of the connection of connector halves 150 and 250 shown in FIG. 4. In FIG. 5, a length 211 represents the inner diameter of outer conductor 202. Nonconductive filling 206 provides support for center connector 203. Angled flat regions 107 and 207 are shown providing a wiping contact at a location 112. Coupled thread 222 is shown to reside on outer threaded body 208.

The dimensions of the outer conductor inner diameter can be scaled further down in size, for example, to 0.5 mm (0.0197 Inch) or less to work up to 220 GHz and above. In this case the outer diameter of the center conductor also has to be correspondingly reduced. The subsequent smaller/higher frequency versions can be interconnected with this configuration with a relatively small additional reflection and no mechanical problems at the interface of the two transmission lines.

The foregoing discussion discloses and describes merely exemplary methods and embodiments of the present invention. As will be understood by those familiar with the art, the invention may be embodied in other specific forms without departing from the spirit or essential characteristics thereof. For example, an embodiment of a connector used for micro-circuit housing is disclosed. The invention works equally well for connection of coaxial cables when a different detail is used on the ends of the connector halves away from the mating plane. Accordingly, the disclosure of the present invention is intended to be illustrative, but not limiting, of the scope of the invention, which is set forth in the following claims.

We claim:

1. A connector assembly comprising:

a first connector half, including:

a first transmission line, the first transmission line including:

a first outer conductor, and a first center conductor electrically isolated from the first outer conductor, the first center conductor having a first end, the first end having an angled flat region; and, a second connector half, including:

a second transmission line, the second transmission line including:

a second outer conductor, and a second center conductor electrically isolated from the second outer conductor, the second center conductor having a first end, the first end of the second center conductor having an angled flat region;

wherein when the first connector half and the second connector half are connected together, the first outer conductor is electrically connected to the second outer conductor and a wiping contact is established between the angled flat region of the first end of the first center conductor and the angled flat region of the first end of the second center conductor.

2. A connector assembly as in claim 1:

wherein when the first connector half and the second connector half are connected together, cogs on the first connector half and the second connector half orient the first connector half to the second connector half in such a way that the angled flat region of the first end of the first center conductor and the angled flat region of the first end of the second center conductor are flush against each other.

3. A connector assembly as in claim 1:

wherein the first connector half includes a first coupling body having a first flat;

wherein the second connector half includes a second coupling body having a second flat; and wherein when the first connector half and the second connector half are connected together, cogs on the first coupling body and the second coupling body orient the first connector half to the second connector half in such a way that the angled flat region of the first end of the first center conductor and the angled flat region of the first end of the second center conductor are flush against each other.

4. A connector assembly as in claim 1:

wherein the first connector half includes:

a first body having threads, and a first coupling nut;

wherein the second connector half includes:

a second body having threads, and a second coupling nut; and, wherein when the first connector half and the second connector half are connected together, the first coupling nut is in contact with threads of the first body and threads of the second body.

5. A connector assembly as in claim 1:

wherein the first connector half has a first coupling body;

wherein the second connector half has a second coupling body; and wherein cogs on the first flat coupling body and the second coupling body allow only one orientation of the first connector half to the second connector half when fully connected.

6. A method for connecting a first transmission line to a second transmission line, the method comprising the following steps:

(a) bringing a first outer conductor of the first transmission line into electrical connection to a second outer conductor of the second; and, (b) substantially simultaneous to step (a), establishing a wiping contact between an angled flat region at a first end of a first center conductor of the first transmission line and an angled flat region at a first end of a second center conductor of a second transmission line.

7. A method as in claim 6 additionally comprising the following step performed substantially simultaneous to step (b):

(c) orienting the first end of the first center conductor of the first transmission line with the first end of the second center conductor of the transmission line using a first coupling body having a first flat and a second coupling body having a second flat.

8. A method as in claim 7 wherein in step (c) cogs on the first flat and the second flat are used in orientation of the first end of the first center conductor of the first transmission line with the first end of the second center conductor of the transmission line.

9. A method as in claim 6 additionally comprising the following step:

(c) using a coupling nut to hold in place the first transmission line and the second transmission line.

10. A connector assembly comprising:

a first connector half, including:

a first transmission line, the first transmission line including:

a first conductor, the first conductor having a first end, the first end having an angled flat region; and, a second connector half, including:

a second transmission line, the second transmission line including:

a second conductor, the second conductor having a first end, the first end of the second conductor having an angled flat region;

wherein when the first connector half and the second connector half are connected together, a wiping contact is established between the angled flat region of the first end of the first conductor and the angled flat region of the first end of the second conductor.

11. A connector assembly as in claim 10:

wherein when the first connector half and the second connector half are connected together, cogs on the first connector half and the second connector half orient the first connector half to the second connector half in such a way that the angled flat region of the first end of the first conductor and the angled flat region of the first end of the second conductor are flush against each other.

12. A connector assembly as in claim 10:

wherein the first connector half includes a first coupling body having a first flat;

wherein the second connector half includes a second coupling body having a second flat; and wherein when the first connector half and the second connector half are connected together, cogs on the first coupling body and the second coupling body orient the first connector half to the second connector half in such a way that the angled flat region of the first end of the first conductor and the angled flat region of the first end of the second conductor are flush against each other.

13. A connector assembly as in claim 10:

wherein the first connector half includes:

a first body having threads, and a first coupling nut;

wherein the second connector half includes:

a second body having threads, and a second coupling nut; and, wherein when the first connector half and the second connector half are connected together, the first coupling nut is in contact with threads of the first body and threads of the second body.

14. A connector assembly as in claim 10:

wherein the first connector half has a first coupling body;

wherein the second connector half has a second coupling body; and wherein cogs on the first flat coupling body and the second coupling body allow only one orientation of the first connector half to the second connector half when fully connected.

* * * * *